US010978832B1

(12) United States Patent
Schroll et al.

(10) Patent No.: US 10,978,832 B1
(45) Date of Patent: Apr. 13, 2021

(54) PROTECTION MEMBER TO PROTECT RESILIENT ARMS OF A CONTACT ASSEMBLY FROM STUBBING

(71) Applicant: TE Connectivity Services GmbH, Schaffhausen (CH)

(72) Inventors: Neil Franklin Schroll, Mount Joy, PA (US); Nathan William Swanger, Dillsburg, PA (US)

(73) Assignee: TE Connectivity Services GmbH

( * ) Notice: Subject to any disclaimer, the term of this patent is extended or adjusted under 35 U.S.C. 154(b) by 0 days.

(21) Appl. No.: 16/784,626

(22) Filed: Feb. 7, 2020

(51) Int. Cl.

| | |
|---|---|
| ***H01R 13/6592*** | (2011.01) |
| ***H01R 13/646*** | (2011.01) |
| ***H01R 13/506*** | (2006.01) |
| ***H01R 24/44*** | (2011.01) |
| *H01R 24/54* | (2011.01) |
| *H01R 9/05* | (2006.01) |
| *H01R 24/86* | (2011.01) |

(52) U.S. Cl.
CPC ..... *H01R 13/6592* (2013.01); *H01R 13/506* (2013.01); *H01R 13/646* (2013.01); *H01R 24/44* (2013.01); *H01R 9/05* (2013.01); *H01R 9/0503* (2013.01); *H01R 24/547* (2013.01); *H01R 24/86* (2013.01)

(58) Field of Classification Search
CPC ..... H01R 24/44; H01R 24/547; H01R 9/05; H01R 9/0503; H01R 24/86
See application file for complete search history.

(56) References Cited

U.S. PATENT DOCUMENTS

| | | | | |
|---|---|---|---|---|
| 5,607,328 | A * | 3/1997 | Joly | H01R 13/11 439/851 |
| 5,624,283 | A * | 4/1997 | Hotea | H01R 13/18 439/751 |
| 9,281,598 | B2 | 3/2016 | Zebhauser et al. | |
| 9,941,608 | B2 | 4/2018 | Zebhauser et al. | |
| 10,249,995 | B2 | 4/2019 | Zebhauser et al. | |
| 10,347,397 | B2 | 7/2019 | Armbrecht et al. | |
| 10,389,062 | B2 | 8/2019 | Zebhauser et al. | |
| 10,396,472 | B2 | 8/2019 | Baldauf et al. | |
| 10,553,977 | B2 | 2/2020 | Pemwieser et al. | |
| 10,594,104 | B2 | 3/2020 | Hofling | |
| 10,700,480 | B2 * | 6/2020 | Annequin | H01R 13/6591 |
| 2009/0197482 | A1 * | 8/2009 | Mark | H01R 43/16 439/852 |
| 2015/0132994 | A1 | 5/2015 | Zebhauser et al. | |

(Continued)

*Primary Examiner* — Tho D Ta

(57) ABSTRACT

A cable assembly for terminating a cable. The cable assembly includes a cable assembly mating end and a cable assembly cable receiving end. A metallic outer shell is positioned proximate to the cable assembly mating end of the cable assembly. The metallic outer shell has a mating contact engagement portion. A housing made of dielectric material is positioned in the metallic outer shell. Resilient contact arms are provided on the mating contact engagement portion of the metallic outer shell. The resilient contact arms extend from proximate the cable assembly mating end. Front ends of the resilient contact arms are provided proximate the cable assembly mating end and cooperate with a protection portion of the cable assembly which extends from the cable assembly mating end to prevent the front ends of the resilient contact arms from stubbing when the cable assembly is mated to a mating assembly.

17 Claims, 9 Drawing Sheets

(56) References Cited

U.S. PATENT DOCUMENTS

| | | | |
|---|---|---|---|
| 2017/0040087 | A1 | 2/2017 | Armbrecht et al. |
| 2018/0366856 | A1 | 12/2018 | Pemwieser et al. |
| 2019/0058296 | A1 | 2/2019 | Bredbeck |
| 2019/0148865 | A1 | 5/2019 | Zebhauser et al. |

* cited by examiner

PROTECTION MEMBER TO PROTECT RESILIENT ARMS OF A CONTACT ASSEMBLY FROM STUBBING

FIELD OF THE INVENTION

The present invention is directed a contact sleeve or assembly with resilient contact arms. In particular, the invention is directed to a contact assembly which has a protection member to prevent the stubbing of the contact arms while providing an improved electrical path for grounding.

BACKGROUND OF THE INVENTION

Connectors, in particular coaxial connectors, serve to releasably connect coaxial cables. Coaxial connectors have the advantages of coaxial cables, specifically low electromagnetic influencing and good electrical shielding. Coaxial connectors also have an impedance which corresponds to that of the connected coaxial cable in order to avoid reflection phenomena at the transition point between the coaxial connector and the coaxial cable.

Coaxial connectors are designed to provide a predetermined characteristic impedance in order to ensure reflection-free transmission of RF signals. When mating a coaxial connector with a mating coaxial connector, impedance mismatch often results, causing a degradation in the signal transmitted there across. In addition, with many known connectors, mating the coaxial connector with the mating coaxial connector can cause damage to either the connector or the mating connector, due to issues such as stubbing and the like.

It would, therefore, be beneficial to provide a coaxial connector which provides for an improved electrical path for grounding with a mating connector. It would also be beneficial to provide a coaxial connector which reduces the possibility of stubbing when the connector is mated with the mating connector.

SUMMARY OF THE INVENTION

An embodiment is directed to a cable assembly for terminating a cable. The cable assembly includes a cable assembly mating end and a cable assembly cable receiving end. A metallic outer shell is positioned proximate to the cable assembly mating end of the cable assembly. The metallic outer shell has a mating contact engagement portion. A housing made of dielectric material is positioned in the metallic outer shell. The housing has a housing mating end and an oppositely facing housing conductor receiving end. Terminal receiving openings extend from the housing mating end. The housing extends from proximate the cable assembly mating end toward the cable assembly cable receiving end. Resilient contact arms are provided on the mating contact engagement portion of the metallic outer shell. The resilient contact arms extend from proximate the cable assembly mating end. Front ends of the resilient contact arms are provided proximate the cable assembly mating end and cooperate with a protection portion of the cable assembly which extends from the cable assembly mating end to prevent the front ends of the resilient contact arms from stubbing when the cable assembly is mated to a mating assembly.

An embodiment is directed to an impedance control cable assembly for terminating a cable having exposed conductors. The cable assembly includes a cable assembly mating end and a cable assembly cable receiving end. A first metallic outer shell is positioned proximate to the cable assembly mating end of the cable assembly. The first metallic outer shell has a mating contact engagement portion and a second metallic outer shell mating portion. A second metallic outer shell is position proximate to the cable assembly cable receiving end. The second metallic outer shell is provided in physical and electrical engagement with the first metallic outer shell. A housing made of dielectric material is positioned in the first metallic outer shell and the second metallic outer shell, the housing has a housing mating end and an oppositely facing housing conductor receiving end. Terminal receiving openings extend from the housing mating end to the housing conductor receiving end. The housing extends from proximate the cable assembly mating end toward the cable assembly cable receiving end. Resilient contact arms are provided on the mating contact engagement portion of the first metallic outer shell, the resilient contact arms extend from proximate the cable assembly mating end to the second metallic outer shell mating portion of the first metallic outer shell. Front ends of the resilient contact arms are proximate the cable assembly mating end and cooperate with a protection portion of the cable assembly which extends from the cable assembly mating end to prevent the front ends of the resilient contact arms from stubbing when the cable assembly is mated to a mating assembly.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
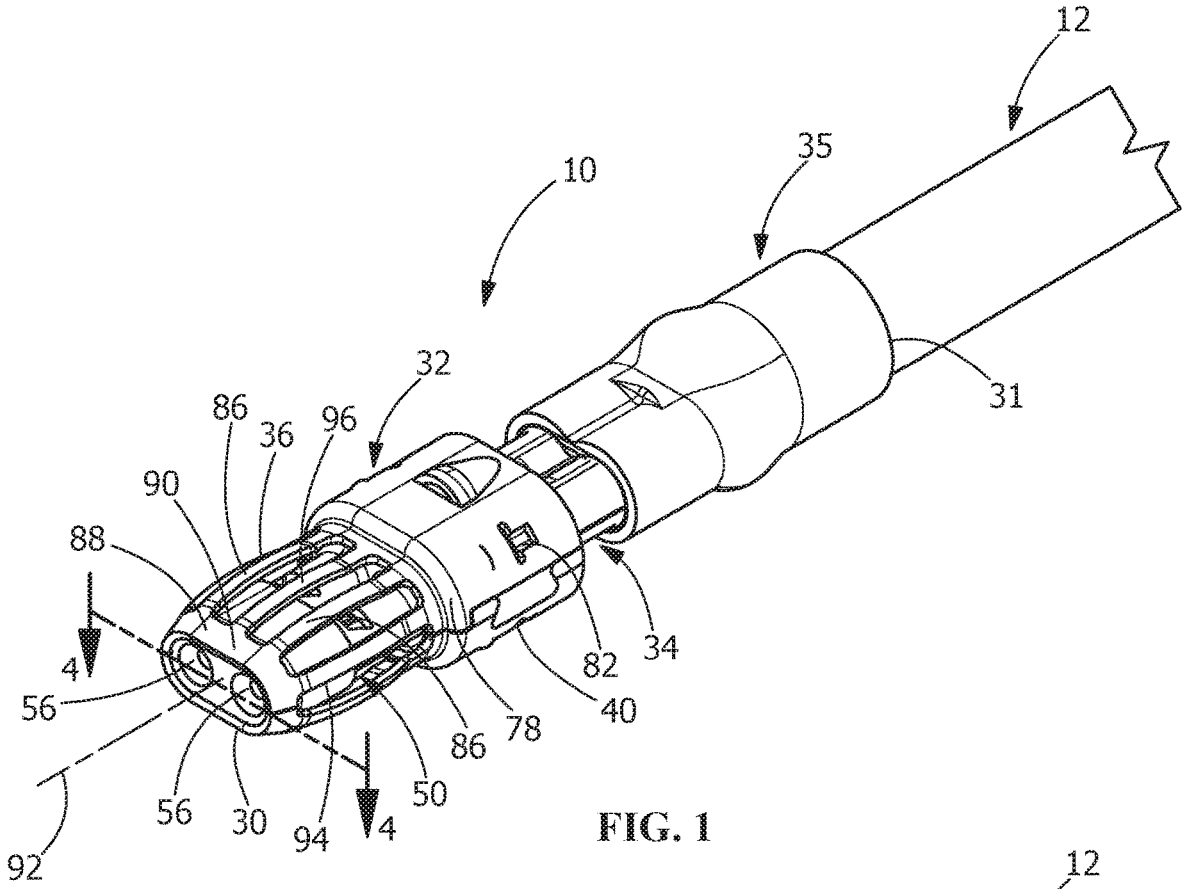
FIG. 1 perspective view of an illustrative electrical connector assembly with an illustrative metal outer shell according to the present invention.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

Moreover, the features and benefits of the invention are illustrated by reference to the preferred embodiments. Accordingly, the invention expressly should not be limited to such embodiments illustrating some possible non-limiting combination of features that may exist alone or in other combinations of features, the scope of the invention being defined by the claims appended hereto.

Figure 4:
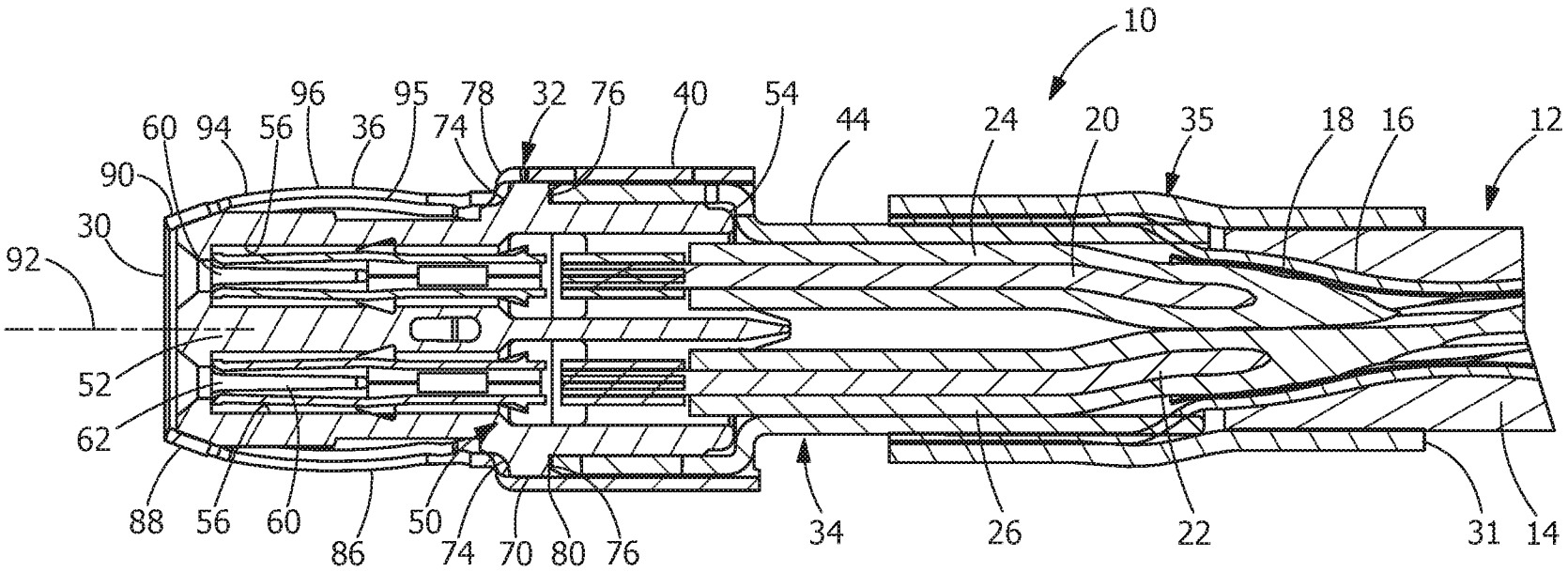
FIG. 4 is a cross-section view taken along line 4-4 of FIG. 1.

As shown in FIGS. 1 and 4, an electrical connector assembly or cable assembly 10 is electrically and mechanically connected to a cable 12. The cable 12 can transfer data between and among storage devices, switches, routers, printed circuit boards (PCBs), analog to digital converters, connectors, and other devices. In various embodiments, the cable 12 can support data transfer rates of 100 Mbps and higher. In some embodiments, the cable 12 can support data transfer rates of approximately 4.25 Gbps to approximately 25 Gbps. The cable 12 also can be used with data transfer rates above or below these exemplary rates. As shown in FIG. 4, the cable 12 has a cable jacket 14, a braided shield 16, a metalized foil 18 and two center conductors 20, 22. An end of the cable 12 has the cable jacket 14 removed. The dielectrics 24, 26 of the conductors 20, 22 are also removed, thereby exposing a portion of the conductors 20, 22.

The electrical connector assembly 10 has a cable assembly mating end 30 and a cable assembly cable receiving end 31. The connector assembly 10 includes a first metallic outer shell 32, a second metallic outer shell 34 and a third metallic outer shell 35. The first metallic outer shell 32 has a mating connector receiving portion 36 and a second metallic outer shell receiving portion 40. The second metallic outer shell 34 has a first metallic outer shell receiving portion 42 and a conductor transition portion 44.

A dielectric housing 50 is positioned in the electrical connector assembly 10. The housing 50 made of dielectric material. As shown in FIG. 4, the housing 50 has a mating end 52 and an oppositely facing conductor receiving end 54. Terminal receiving openings 56 extend from the mating end 52 to the conductor receiving end 54. The terminal receiving openings 56 are dimensioned to receive terminals 60 (FIGS. 2 and 4) through the conductor receiving end 54. The terminals 60 are electrically connected to the exposed ends of the conductors 20, 22 of the cable 12. In the embodiment shown, two terminal receiving openings 56 are provided, however other numbers and configurations of the terminal receiving openings may be used.

The dielectric housing 50 has mounting projections 70 which extend from side surface 72 thereof. The mounting projections each have a first shell engagement surface 74 and a second shell engagement surface 76.

When assembled, as shown in FIG. 4, the dielectric housing 50 is positioned in the mating connector receiving portion 36 and the second metallic outer shell receiving portion 40 of the first metallic outer shell 32. The first shell engagement surfaces 74 of the mounting projections 70 engage an inner transition wall 78 of the mating connector receiving portion 36 to properly position the housing 50 and prevent the further movement of the housing 50 into the mating connector receiving portion 36.

An end 80 of first metallic outer shell receiving portion 42 of the second metallic outer shell 34 is positioned within the second metallic outer shell receiving portion 40 of the first metallic outer shell 32. One or more latches 82 of the first metallic outer shell 32 cooperate with one or more openings 84 of the second metallic outer shell 34 to secure the second metallic outer shell 34 to the first metallic outer shell 32. Alternatively, the second metallic outer shell 34 is secured to the first metallic outer shell 32 by adhesive, or other know methods of attachment. In this position, the end 80 of the second metallic outer shell 34 engages the second shell engagement surfaces 76 of the mounting projections 70 to properly position the housing 50 and prevent the movement of the housing 50 into the second metallic outer shell 34.

Figure 2:
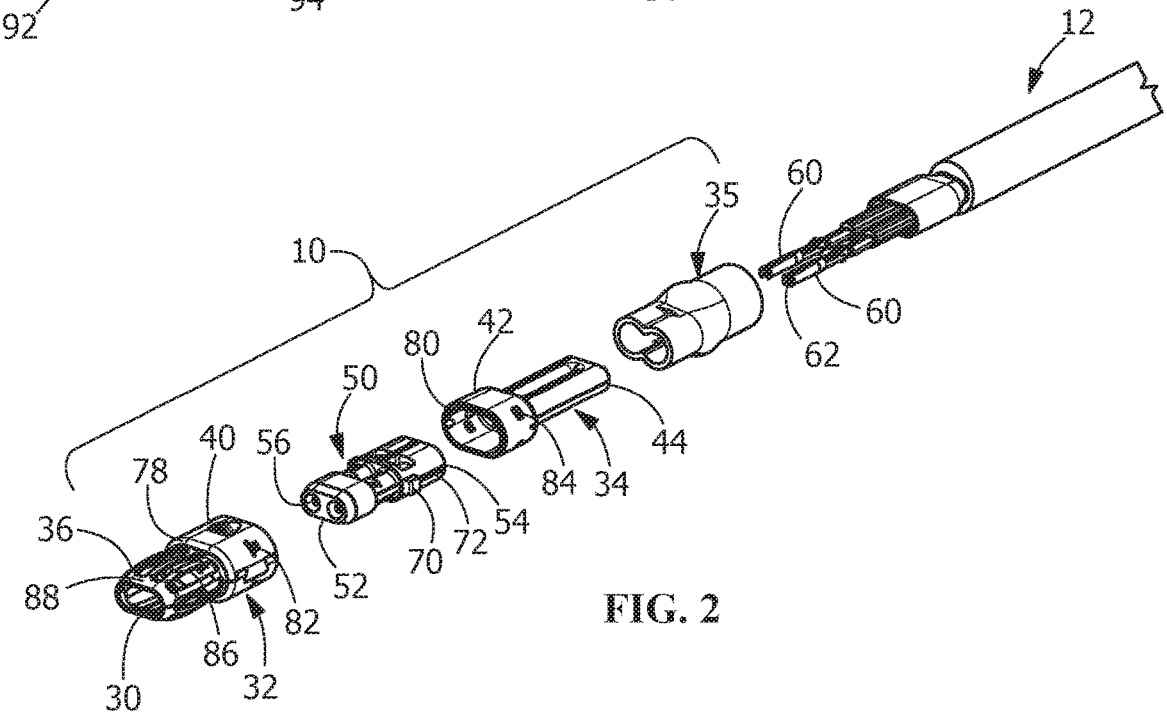
FIG. 2 is an exploded view of the electrical connector assembly of FIG. 1.

As shown in FIGS. 2 and 4, the terminals 60 of the electrical connector assembly 10 are terminated to ends of the conductors 20, 22 of the cable 12, such as by crimping. However, other methods of terminating the terminals 60 to the conductors 20, 22 may be used. In the illustrative embodiment shown, the terminals 60 are female terminals with receptacle portions 62. However, other configurations of terminals, including, but not limited to, female socket terminals, may be used. With the terminals 60 properly terminated to the conductors 20, 22, the terminals 60 are inserted through the conductor transition portion 44 and into the terminal receiving openings 56.

Figure 3:
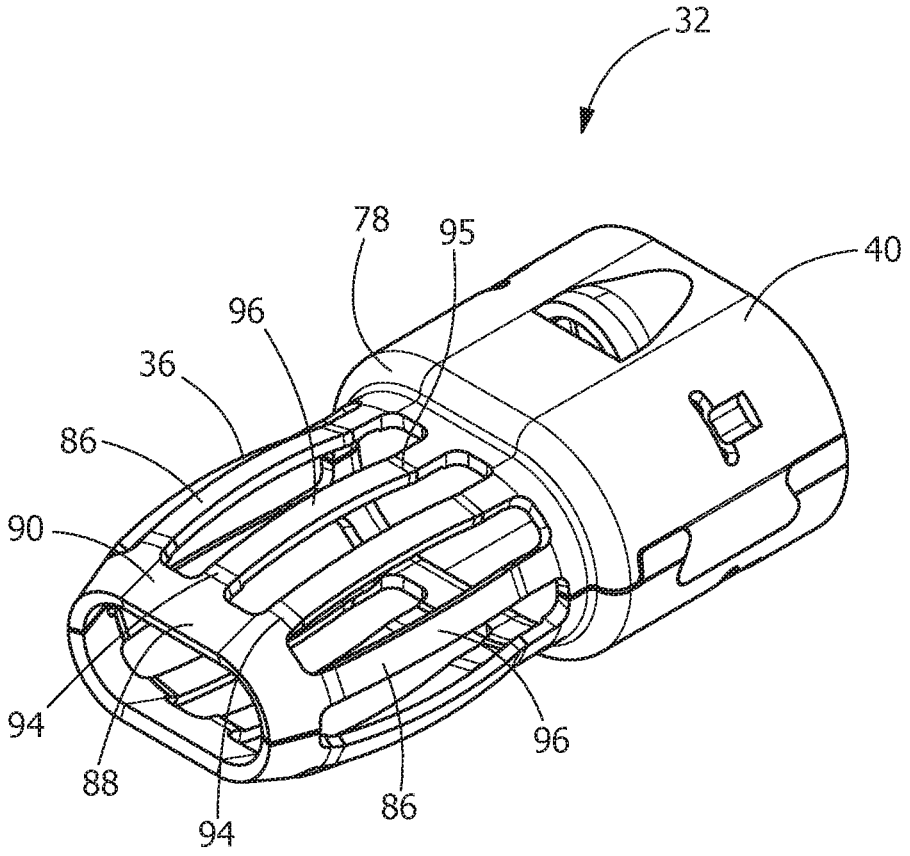
FIG. 3 is an enlarged perspective view of the metal outer shell of FIG. 1.

Referring to FIG. 3, the mating connector receiving portion 36 of the first metallic outer shell 32 has resilient contact arms 86 which extend from the second metallic outer shell receiving portion 40 to an electrically conductive protection member or portion 88 of the mating connector receiving portion 36. The protection member 88 is positioned proximate to and extends from the cable assembly mating end 30. The protection member 88 surrounds the mating end 52 of the housing 50, but does not cover the terminal receiving openings 56. The protection member 88 has an outer surface 90 which is tapered toward a longitudinal axis 92 of the cable assembly 10. The tapered shape of the outer surface 90 acts as a lead-in surface when a mating connector is mated to the connector assembly 10.

The resilient contact arms 86 have front ends 94 which are proximate the cable assembly mating end 30 and which cooperate with the protection member 88. As shown in FIG. 3, the front ends 94 of the resilient contact arms 86 are integrally formed and attached to the protection member 88 of the mating connector receiving portion 36 of the first metallic outer shell 32. Rear ends 95 of the resilient contact arms 86 are positioned away from the cable assembly mating end 30 and are integrally formed and attached to the inner transition wall 78 of the mating connector receiving portion 36. The resilient contact arms 86 are bowed, wherein center sections 96 of the resilient contact arms 86 are spaced further from a longitudinal axis 92 of the cable assembly 10 than the front ends 94 of the resilient contact arms 86 or the protection member 88. In various embodiments, the center sections 96 may have enlarged contact sections which provide a greater surface area to engage the mating connector when the mating connector is mated to the connector assembly 10.

The use of the resilient contact arms 86 and the bowed center sections 96 provide for increased connection between the mating connector (not shown) and the connector assembly 10. In addition, as the resilient contact arms 86 are supported at both ends, the resilient contact arms 86 provide for enhanced structural integrity of the mating connector receiving portion 36 of the first metallic outer shell 32.

As the connector assembly 10 is mated with the mating connector, the bowed center sections 96 of the resilient contact arms 86 engage a cavity (not shown) of the mating connector, causing the bowed center sections 96 to resiliently deform toward the longitudinal axis 92 of the cable assembly 10. As the front ends 94 and the rear ends 95 are fixed, the bowed center sections 96 resist the inward movement of the bowed center sections 96, thereby causing a force to be applied to the mating connector. The fixed front ends 94 and rear ends 95 also cause the center of the bowed center sections 96 to deform more than the ends of the bowed center sections 96, causing the bowed center sections 96 to become flatter, thereby providing more connection points and surfaces for the electrical connection or pathway between the mating connector and the connector assembly 10. In addition, as the front ends 94 are connected to the electrically conductive protection member 88, the entire length of the resilient contact arms 86 and the electrically conductive protection member 88 provide an electrical path thereby facilitating high speed transmission and better EMI performance, in contrast to prior connectors in which the contact arms are fixed or non-deformable and do not connector to an electrically conductive member at both ends, resulting in the contact arm being electrically isolated and therefore, the EMI performance is not enhanced.

As the front ends 94 of the resilient contact arms 86 are integrally attached to the protection member 88, free edges of the front ends 94 are not free or exposed and therefore cannot engage the mating connector as the mating connector is mated to the connector assembly 10. In addition, as compared to the prior art which has contact arms 86 with free floating end surface, the outer surface 90 of the integrally formed protection member 88 acts as a lead-in surface when a mating connector is initially mated to the connector assembly 10 and as the mating connector is moved over the outer surface 90 and the contact arms 86. Stubbing of the mating connector on the resilient contact arms 86 is thereby minimized or prevented.

Figure 5:
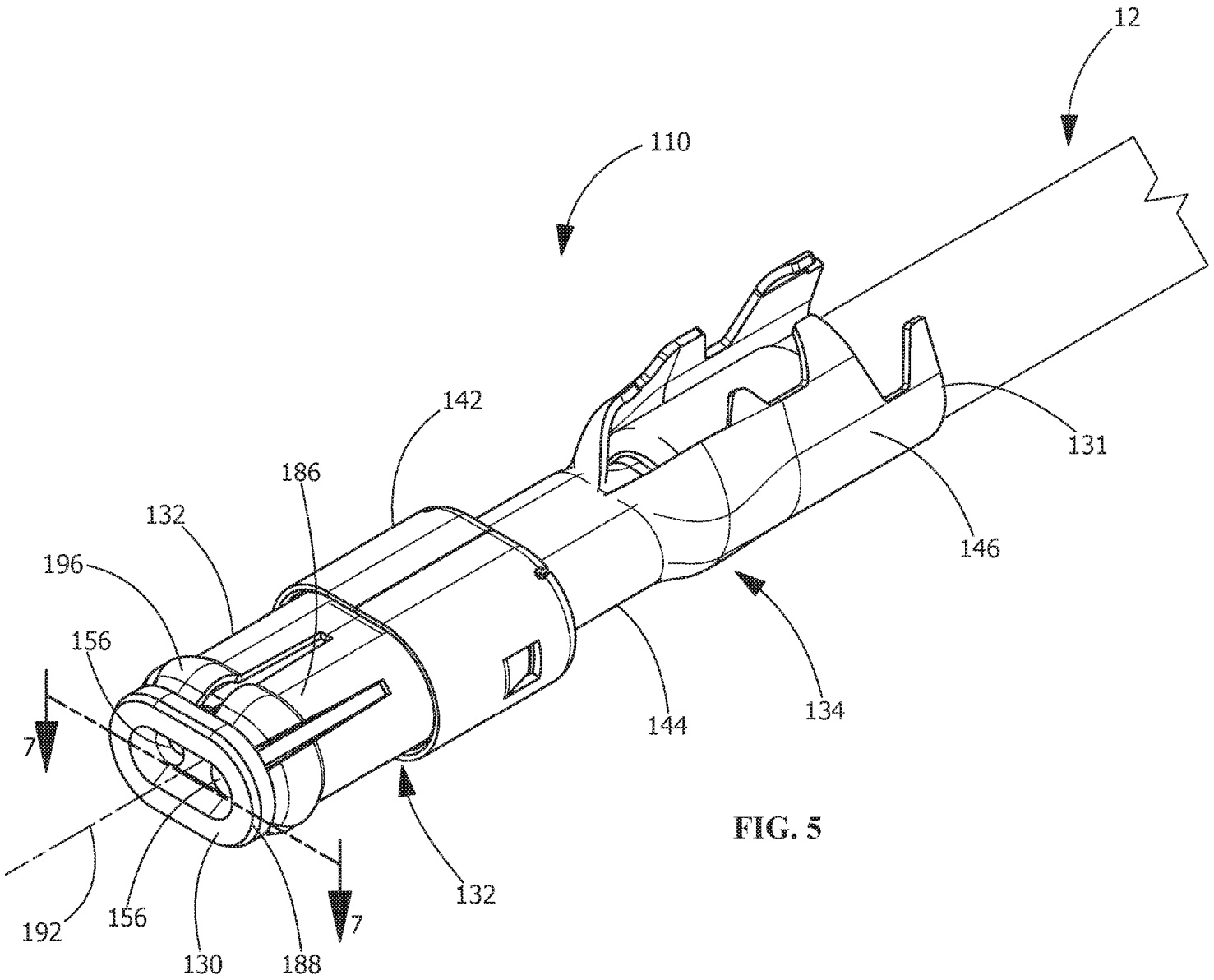
FIG. 5 is a perspective view of a first alternate illustrative electrical connector assembly with a first alternate illustrative metal outer shell according to the present invention.
Figure 6:
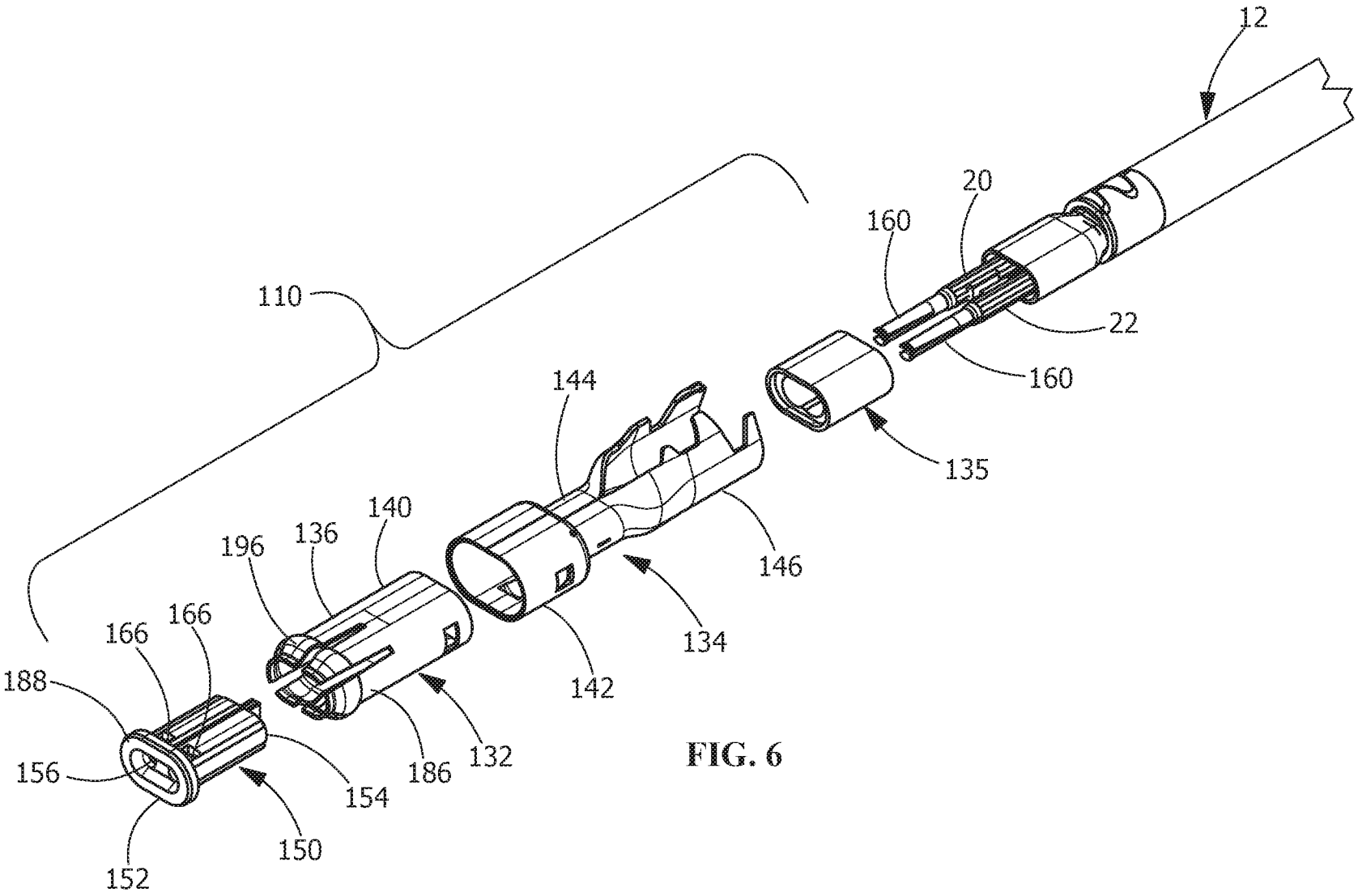
FIG. 6 is an exploded view of the electrical connector assembly of FIG. 5.
Figure 7:
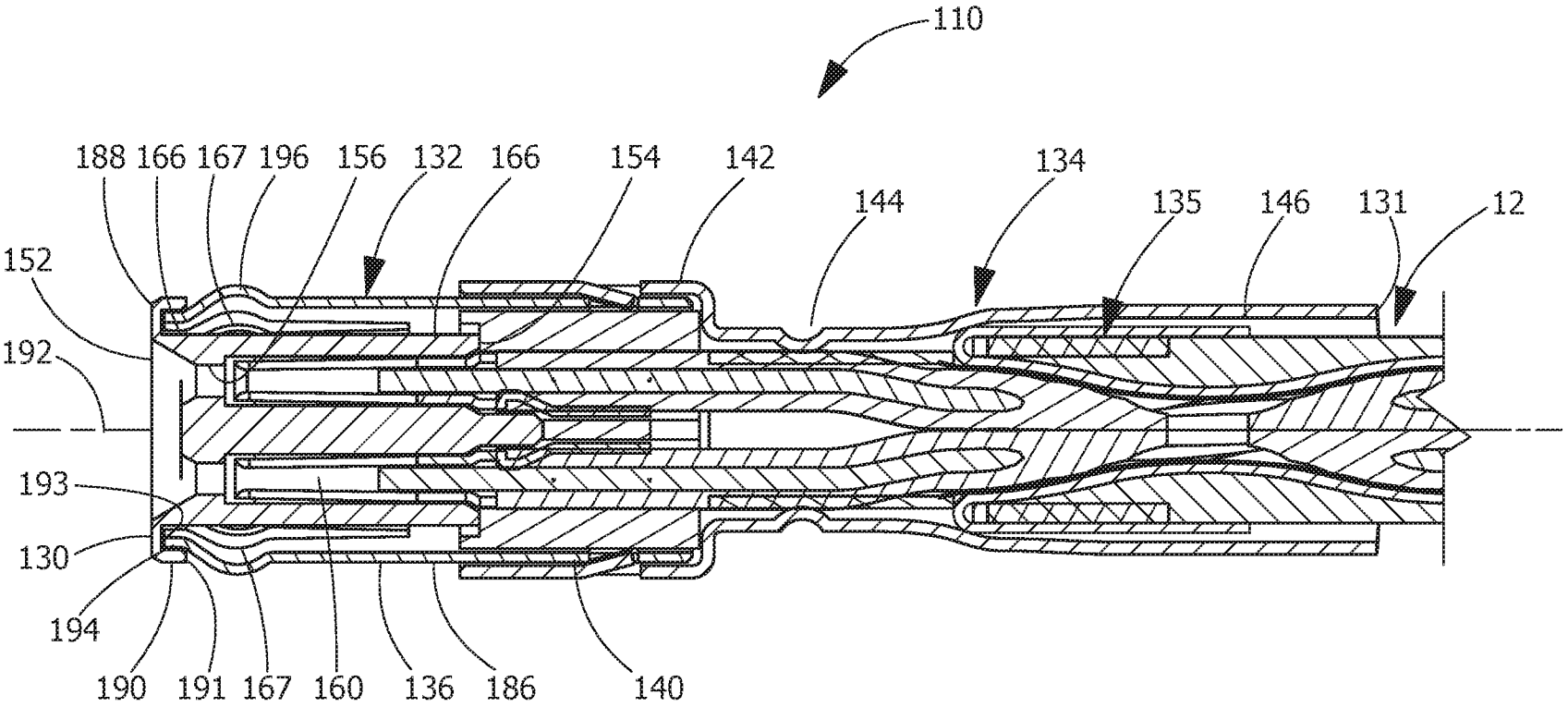
FIG. 7 is a cross-section view taken along line 7-7 of FIG. 5.

An alternate embodiment of the electrical connector 110 is shown in FIGS. 5 through 7. The electrical connector assembly 110 is electrically and mechanically connected to a cable 12. The electrical connector assembly 110 has a cable assembly mating end 130 and a cable assembly cable receiving end 131. The connector assembly 110 includes a first metallic outer shell 132, a second metallic outer shell 134 and a third metallic outer shell 135. As shown in FIG. 6, the first metallic outer shell 132 has a mating connector receiving portion 136, which is also a housing retention portion, and a second metallic outer shell receiving portion 140. The second metallic outer shell 134 has a first metallic outer shell receiving portion 142, a conductor transition portion 144 and a third metallic shell cooperating portion 146.

A dielectric housing 150 is positioned in the electrical connector assembly 110. The housing 150 made of dielectric material. As shown in FIGS. 6 and 7, the housing 150 has a mating end 152 and an oppositely facing conductor receiving end 154. Terminal receiving openings 156 extend from the mating end 152 to the conductor receiving end 154. The terminal receiving openings 156 are dimensioned to receive terminals 160 (FIG. 2) through the conductor receiving end 154. The terminals 160 are electrically connected to the exposed ends of the conductors 20, 22 of the cable 12. In the embodiment shown, two terminal receiving openings 156 are provided, however other numbers and configurations of the terminal receiving openings may be used.

The dielectric housing 150 has recess 166 which extend from proximate the mating end 152 toward the conductor receiving end 154. Raised projections or areas 167 (FIG. 7) are provided proximate the recesses 166. A protection member 188 is provided at the mating end 152 of the housing 150. The protection member 188 is made of dielectric material and is integrally molded with the housing 150. The protection member 188 surrounds the mating end 152 of the housing 150, but does not cover the terminal receiving openings 156. As shown in FIG. 7, the protection member 188 has an outer surface 190 with a shoulder 191 which defines a resilient arm receiving cavity 193.

The mating connector receiving portion 136 of the first metallic outer shell 132 has resilient contact arms 186 which extend from the second metallic outer shell receiving portion 140. The resilient contact arms 186 have front ends 194 which are proximate the cable assembly mating end 130 and which cooperate with the protection member 188. The front ends 194 of the resilient contact arms 186 have curved or arcuate contact sections 196, wherein curved contact sections 196 of the resilient contact arms 186 are spaced further from a longitudinal axis 192 of the cable assembly 110 than the front ends 194 of the resilient contact arms 186 or the protection member 188.

During assembly of the dielectric housing 150 into the first metallic outer shell 132, the front ends 194 of the resilient contact arms 186 of the first metallic outer shell 132 are resiliently deformed away from the longitudinal axis 192 by the raised areas 167 of the housing 150. Continued insertion allows the front ends 194 to move beyond the raised areas 167, allowing the resilient contact arms 186 to return toward their unstressed position. In this position, the front ends 194 are positioned in the recesses 166, thereby retaining the housing 150 in the first metallic outer shell 132. In this position, the front ends 194 are also positioned in the resilient arm receiving cavity 193 of the protection member 188, with the shoulder 191 positioned over the front ends 194 of the resilient contact arms 186.

The use of the resilient contact arms 186 and the curved contact sections 196 provides for increased connection between the mating connector (not shown) and the connector assembly 110. In addition, as the free ends 194 of the resilient contact arms 186 are supported by the housing 150, the movement of the resilient contact arms 186 toward the longitudinal axis 192 of the cable assembly 110 is limited, thereby providing for enhanced structural integrity of the mating connector receiving portion 136 of the first metallic outer shell 132.

As the connector assembly 110 is mated with the mating connector, the curved contact sections 196 of the resilient contact arms 186 engage a cavity (not shown) of the mating connector, causing the curved contact sections 196 to deform toward the longitudinal axis 192 of the cable assembly 110. As the front ends 194 are supported by the housing 150, the curved contact sections 196 are prevented from inward movement, thereby causing a force to be applied by the curved contact sections 196 to the mating connector. As the front ends 194 are prevented from movement, the curved contact sections 196 are deformed as mating occurs. The deformation of the curved contact sections 196 causes the curved contact sections 196 to become flatter, thereby providing more connection points and surfaces for the electrical connection or pathway between the mating connector and the connector assembly 110.

As the front ends 194 of the resilient contact arms 186 are protected or sheltered by the protection member 188, free edges of the front ends 194 are not free or exposed and therefore cannot engage the mating connector as the mating connector is mated to the connector assembly 110, thereby minimizing or preventing stubbing of the resilient contact arms 186 when the connector assembly 110 is mated with the mating connector.

Figure 8:
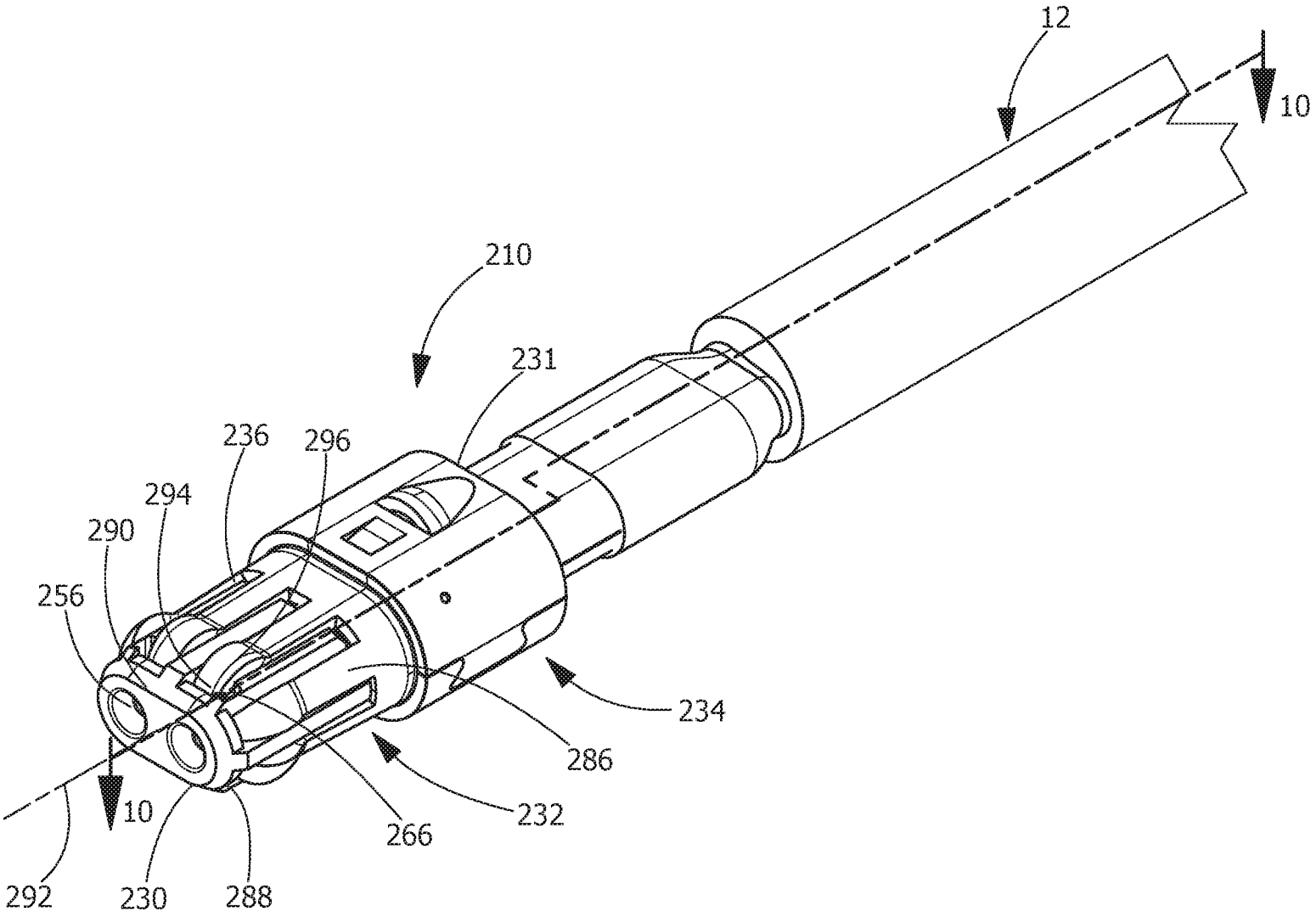
FIG. 8 is a perspective view of a second alternate illustrative electrical connector assembly with a second alternate illustrative metal outer shell according to the present invention.
Figure 9:
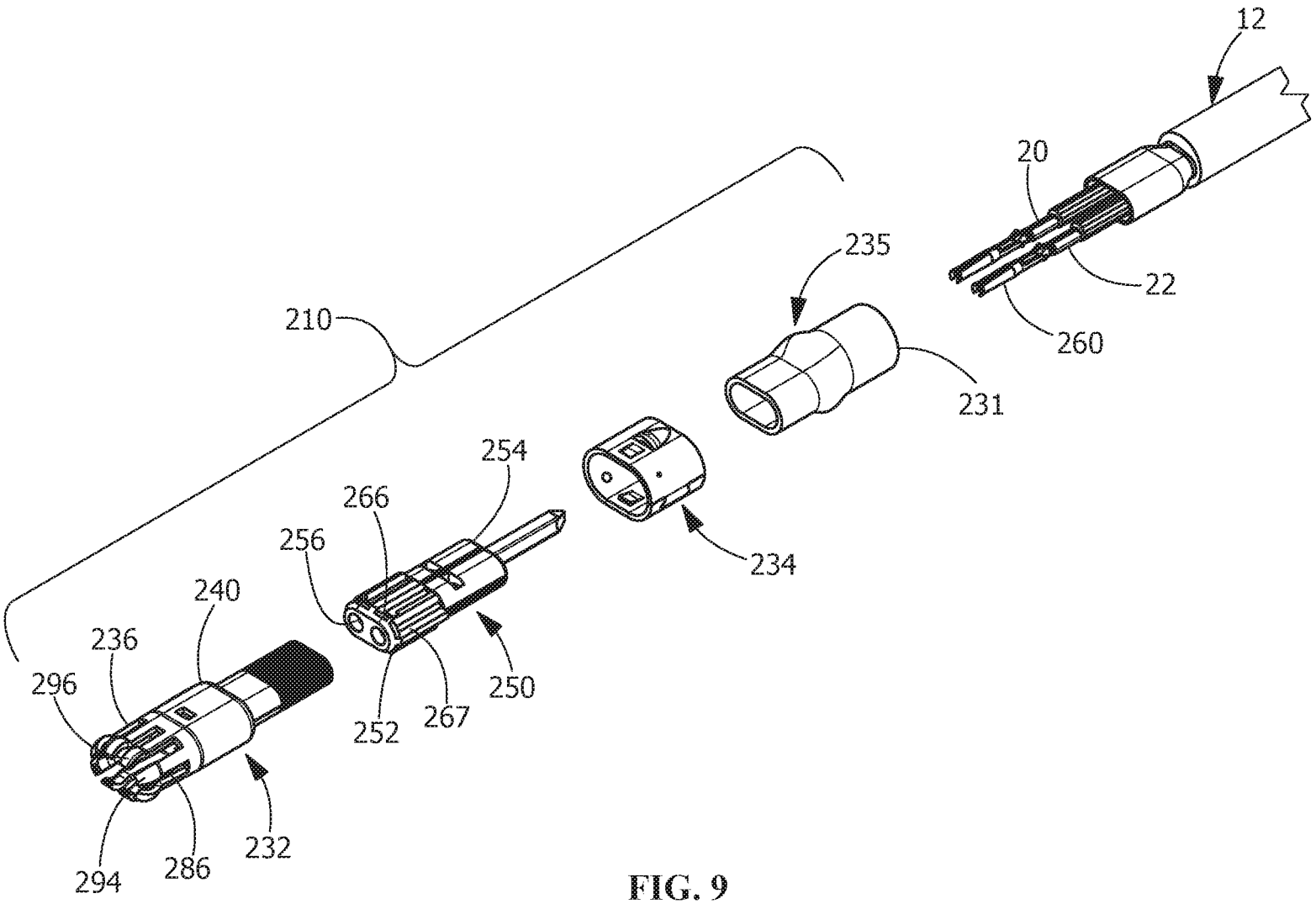
FIG. 9 is an exploded view of the electrical connector assembly of FIG. 8.
Figure 10:
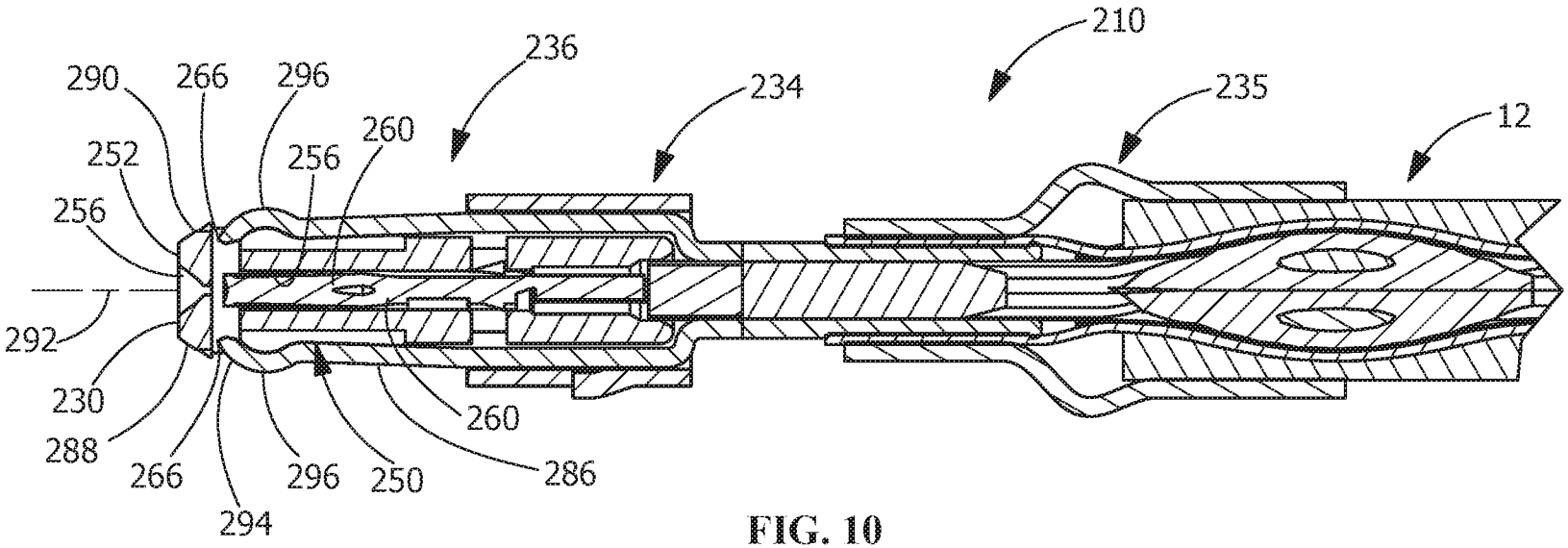
FIG. 10 is a cross-section view taken along line 10-10 of FIG. 8.

A second alternate embodiment of the electrical connector 210 is shown in FIGS. 8 through 10. The electrical connector assembly 210 is electrically and mechanically connected to a cable 12. The electrical connector assembly 210 has a cable assembly mating end 230 and a cable assembly cable receiving end 231. The connector assembly 210 includes a first metallic outer shell 232 and a second metallic outer shell 234. As shown in FIG. 9, the first metallic outer shell 232 has a mating connector receiving portion 236 and a second metallic outer shell receiving portion 240. The second metallic outer shell 234 has a first metallic outer shell receiving portion 242.

A dielectric housing 250 is positioned in the electrical connector assembly 210. The housing 250 made of dielectric material. As shown in FIGS. 9 and 10, the housing 250 has a mating end 252 and an oppositely facing conductor receiving end 254. Terminal receiving openings 256 extend from the mating end 252 to the conductor receiving end 254. The terminal receiving openings 256 are dimensioned to receive terminals 260 (FIG. 9) through the conductor receiving end 254. The terminals 260 are electrically connected to the exposed ends of the conductors 20, 22 of the cable 12. In the embodiment shown, two terminal receiving openings 256 are provided, however other numbers and configurations of the terminal receiving openings may be used.

The dielectric housing 250 has recesses 266 which extend from proximate the mating end 252 toward the conductor receiving end 254. As shown in FIG. 10, raised projections or areas 267 are provided proximate the recesses 266 A protection member 288 is provided at the mating end 252 of the housing 250. The protection member 288 is made of dielectric material and is integrally molded with the housing 250. The protection member 288 surrounds the mating end 252 of the housing 250, but does not cover the terminal receiving openings 256. The protection member 288 has an outer surface 290 which is tapered toward a longitudinal axis 292 of the cable assembly 10. The tapered shape of the outer surface 290 acts as a lead-in surface when a mating connector is mated to the connector assembly 210.

The mating connector receiving portion 236 of the first metallic outer shell 232 has resilient contact arms 286 which extend from the second metallic outer shell receiving portion 240. The resilient contact arms 286 have front ends 294 which are proximate the cable assembly mating end 230 and which cooperate with the protection member 288. In one embodiment, the front ends 294 are received in recesses 266 of the protection member 288. The front ends 294 of the resilient contact arms 286 have curved or arcuate contact sections 296. The curved contact sections 296 of the resilient contact arms 286 are spaced further from a longitudinal axis 292 of the cable assembly 210 than the front ends 294 of the resilient contact arms 286 or the protection member 288.

During assembly of the dielectric housing 250 into the first metallic outer shell 232, the front ends 294 of the resilient contact arms 286 are resiliently deformed away from the longitudinal axis 292 by the housing 250, as the width of the housing 250 is greater than the opening between the front ends 294 of the resilient contact arms 286. Continued insertion allows the front ends 294 to move into recesses 266, allowing the resilient contact arms 286 to return toward their unstressed position. In this position, the front ends 294 are positioned in the recesses 266, thereby retaining the housing 250 in the first metallic outer shell 232.

The use of the resilient contact arms 286 and the curved contact sections 296 provides for increased connection between the mating connector (not shown) and the connector assembly 210. In addition, as the free ends 294 of the resilient contact arms 286 are supported by the housing 250, the movement of the resilient contact arms 286 toward the longitudinal axis 292 of the cable assembly 210 is limited, thereby providing for enhanced structural integrity of the mating connector receiving portion 236 of the first metallic outer shell 232.

As the connector assembly 210 is mated with the mating connector, the curved contact sections 296 of the resilient contact arms 286 engage a cavity (not shown) of the mating connector, causing the curved contact sections 296 to deform toward the longitudinal axis 292 of the cable assembly 210. As the front ends 294 are supported by the housing 250, the curved contact sections 296 are prevented from inward movement, thereby causing a force to be applied by the curved contact sections 296 to the mating connector. As the front ends 294 are prevented from movement, the curved contact sections 296 are deformed as mating occurs. The deformation of the curved contact sections 296 causes the curved contact sections 296 to become flatter, thereby providing more connection points and surfaces for the electrical connection or pathway between the mating connector and the connector assembly 210.

As the front ends 294 of the resilient contact arms 286 are protected to sheltered by the protection member 288, free edges of the front ends 294 are not free or exposed and therefore cannot engage the mating connector as the mating connector is mated to the connector assembly 210. In addition, as the outer surface 290 act as a lead-in surface when a mating connector is mated to the connector assembly 10, stubbing of the resilient contact arms 86 is minimized or prevented.

While the invention has been described with reference to a preferred embodiment, it will be understood by those skilled in the art that various changes may be made and equivalents may be substituted for elements thereof without departing from the spirit and scope of the invention as defined in the accompanying claims. One skilled in the art will appreciate that the invention may be used with many modifications of structure, arrangement, proportions, sizes, materials and components and otherwise used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. A cable assembly for terminating a cable, the cable assembly comprising:

a cable assembly mating end and a cable assembly cable receiving end;

a metallic outer shell positioned proximate to the cable assembly mating end of the cable assembly, the metallic outer shell having a mating connector receiving portion;

a housing made of dielectric material positioned in the metallic outer shell, the housing having a housing mating end and an oppositely facing housing conductor receiving end, terminal receiving openings extend from the housing mating end, the housing extends from proximate the cable assembly mating end toward the cable assembly cable receiving end;

resilient contact arms provided on the mating connector receiving portion of the metallic outer shell, the resilient contact arms extend from proximate the cable assembly mating end, front ends of the resilient contact arms are proximate the cable assembly mating end and cooperate with a protection portion of the cable assembly; and the protection portion has a shoulder which extends over the front ends of the resilient contact arms.

2. The cable assembly as recited in claim 1, wherein the protection portion of the cable assembly is provided on the metallic outer shell.

3. The cable assembly as recited in claim 2, wherein the front ends of the resilient contact arms are integrally formed and attached to the protection portion of the cable assembly.

4. The cable assembly as recited in claim 3, wherein the resilient contact arms are bowed, wherein center sections of the resilient contact arms are spaced further from a longitudinal axis of the cable assembly than the front ends of the resilient contact arms.

5. The cable assembly as recited in claim 4, wherein the center sections have enlarged contact sections.

6. The cable assembly as recited in claim 1, wherein the protection portion of the cable assembly is provided on the housing.

7. The cable assembly as recited in claim 6, wherein the housing has resilient contact arm receiving recesses which extend from the protection portion toward the cable assembly cable receiving end.

8. The cable assembly as recited in claim 7, wherein the front ends of the resilient contact arms are positioned in the resilient contact arm receiving recesses.

9. The cable assembly as recited in claim 8, wherein the shoulder of the protection portion extends over portions of the resilient contact arm receiving recesses.

10. The cable assembly as recited in claim 8, wherein mating assembly contact portions are provided proximate the front ends of the resilient contact arms, the mating assembly contact portions are spaced further from a longitudinal axis of the cable assembly than the protection portion of the housing.

11. An impedance control cable assembly for terminating a cable having exposed conductors, the cable assembly comprising:

a cable assembly mating end and a cable assembly cable receiving end;

a first metallic outer shell positioned proximate to the cable assembly mating end of the cable assembly, the first metallic outer shell having a mating connector receiving portion and a second metallic outer shell mating portion;

a second metallic outer shell position proximate to the cable assembly cable receiving end, the second metallic outer shell provided in physical and electrical engagement with the first metallic outer shell;

a housing made of dielectric material positioned in the first metallic outer shell and the second metallic outer shell, the housing having a housing mating end and an oppositely facing housing conductor receiving end, terminal receiving openings extend from the housing mating end to the housing conductor receiving end, the housing extends from proximate the cable assembly mating end toward the cable assembly cable receiving end;

resilient contact arms provided on enlarged contact sections of the mating connector receiving portion of the first metallic outer shell, the resilient contact arms extend from proximate the cable assembly mating end to the second, metallic outer shell mating portion of the first metallic outer shell, front ends of the resilient contact arms are proximate the cable assembly mating end, the front ends of die resilient contact arms cooperate with a protection portion of the cable assembly which extends from the cable assembly mating end to prevent the front ends of the resilient contact arms from stubbing when the cable assembly is mated to a mating assembly;

an outer surface of the protection portion and the front ends of the resilient contact arms form a continuous surface which is sloped inward toward a longitudinal axis of the cable assembly to provide a lead-in surface as the cable assembly is mated to the mating assembly.

12. The impedance control cable assembly as recited in claim 11, wherein the protection portion of the cable assembly is provided on the housing.

13. The impedance control cable assembly as recited in claim 11, wherein mating assembly contact portions are provided proximate the front ends of the resilient contact arms, the mating assembly contact portions are spaced further from the longitudinal axis of the cable assembly than the protection portion of the housing.

14. The impedance control cable assembly as recited in claim 11, wherein the protection portion of the cable assembly is provided on the first metallic outer shell.

15. The impedance control cable assembly as recited in claim 14, wherein the front ends of the resilient contact arms are integrally formed and attached to the protection portion of the cable assembly.

16. The impedance control cable assembly as recited in claim 15, wherein the resilient contact arms are bowed, wherein center sections of the resilient contact arms are spaced further from a longitudinal axis of the cable assembly than the front ends of the resilient contact arms.

17. The impedance control cable assembly as recited in claim 16, wherein the center sections have the enlarged contact sections.

* * * * *